US006179651B1

(12) United States Patent
Huang

(10) Patent No.: US 6,179,651 B1
(45) Date of Patent: Jan. 30, 2001

(54) STACKED CONNECTOR ASSEMBLY

(75) Inventor: Wayne Huang, Alhambra, CA (US)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/053,190

(22) Filed: Apr. 1, 1998

(51) Int. Cl.[7] ..... H01R 13/66
(52) U.S. Cl. ..... 439/541.5
(58) Field of Search ..... 439/541.5, 540, 439/701, 79, 101, 108

(56) References Cited

U.S. PATENT DOCUMENTS 5,044,984 * 9/1991 Mosser et al. ..... 439/540
5,290,174 * 3/1994 Woratyla et al. ..... 439/540
5,320,555 * 6/1994 Okabe ..... 439/701
5,709,544 * 1/1998 Savage, Jr. ..... 439/541.5

* cited by examiner

*Primary Examiner*—Michael L. Gellner
*Assistant Examiner*—Briggitte Hammond

(57) ABSTRACT

A stacked connector assembly is disclosed, which comprises an upper and a lower electrical connector of the same type, and means having parts integrally formed with the upper and the lower connectors, respectively, for retaining the upper and lower connectors to each other. The upper and the lower connectors both include a first insulative housing defining a front face for mating with a first mating connector, a plurality of conductive contacts received in a plurality of passageways defined in the first housing. The upper connector further comprises a pair of supports extending from a rear face of the first housing and a space defined under a bottom surface of the first housing in front of the supports for snugly receiving the lower connector. A spacer for an electrical connector having guiding keys is also proposed.

7 Claims, 12 Drawing Sheets

STACKED CONNECTOR ASSEMBLY

BACKGROUND OF THE INVENTION

1. Field of The Invention

The present invention relates to an electrical connector assembly, particularly to a stacked connector assembly.

2. The Prior Art

To economically use the limited space within the computer case, stacked connector assemblies are popularly used in the computer field. Some stacked connector assemblies were proposed in, for example, U.S. patent application Ser. Nos. 08/651,565 and 08/746,246 assigned to the same assignee of the present invention. These stacked connector assemblies, though comprise more than one connectors stacked together, require a bracket interposed therebetween for combining the connectors as a whole, which increases the number of main components in the assemblies and thus involves a more complicated process to assemble these components. In addition, in the above-mentioned conventional design, the spacer is integral formed with the housing, which is not convenient in use. Hence, there is a need for a stacked connector assembly which involves less main components and can be assembled more easily than it was and which comprises a spacer formed separately from the housing and capable of being assembled to the housing easily.

SUMMARY OF THE INVENTION

Accordingly, one object of the present invention is to provide a stacked connector assembly without requiring a bracket interposed therein for combining the connectors as a whole.

Another object of the present invention is to provide a stacked connector assembly having a reduced number of main components and to simplify the assembling process.

Still another object of the present invention is to provide a stacked connector assembly which has a simplified assembling process.

One more object of the present invention is to provide a stacked connector assembly which has a spacer that can be formed separately from the housing and assembled to the housing easily.

To fulfill the above-mentioned objects, according to one embodiment of the present invention, a stacked connector assembly comprises an upper and a lower electrical connector of the same type, and means having parts integrally formed with the upper and the lower connectors, respectively, for retaining the upper and lower connectors to each other. The upper and the lower connectors both include a first insulative housing defining a front face for mating with a first mating connector, a plurality of conductive contacts received in a plurality of passageways defined in the first housing. The upper connector further comprises a pair of supports extending from a rear face of the first housing and a space defined under a bottom surface of the first housing in front of the supports for snugly receiving the lower connector.

According to another aspect of the invention, a spacer for an electrical connector is also proposed, which comprises a front thin bar and a rear thick bar integrally formed together, each bar defining two rows of staggered tapered apertures extending through a top and a bottom surface thereof for guiding and positioning conductive contacts extending therethrough. A pair of hooks are formed on opposite lateral sides of the spacer for locking into an electrical connector and a pair of up-standing keys taller than the hooks are provided on both lateral ends of the front bar for guiding attachment of the spacer to an electrical connector.

These and additional objects, features, and advantages of the present invention will become apparent after reading the following detailed description of the embodiments of the invention taken in conjunction with the appended drawing figures.

DETAILED DESCRIPTION OF THE PREFERRED EMBODIMENTS

Detailed reference will now be made to the preferred embodiments of the present invention.

Figure 1:
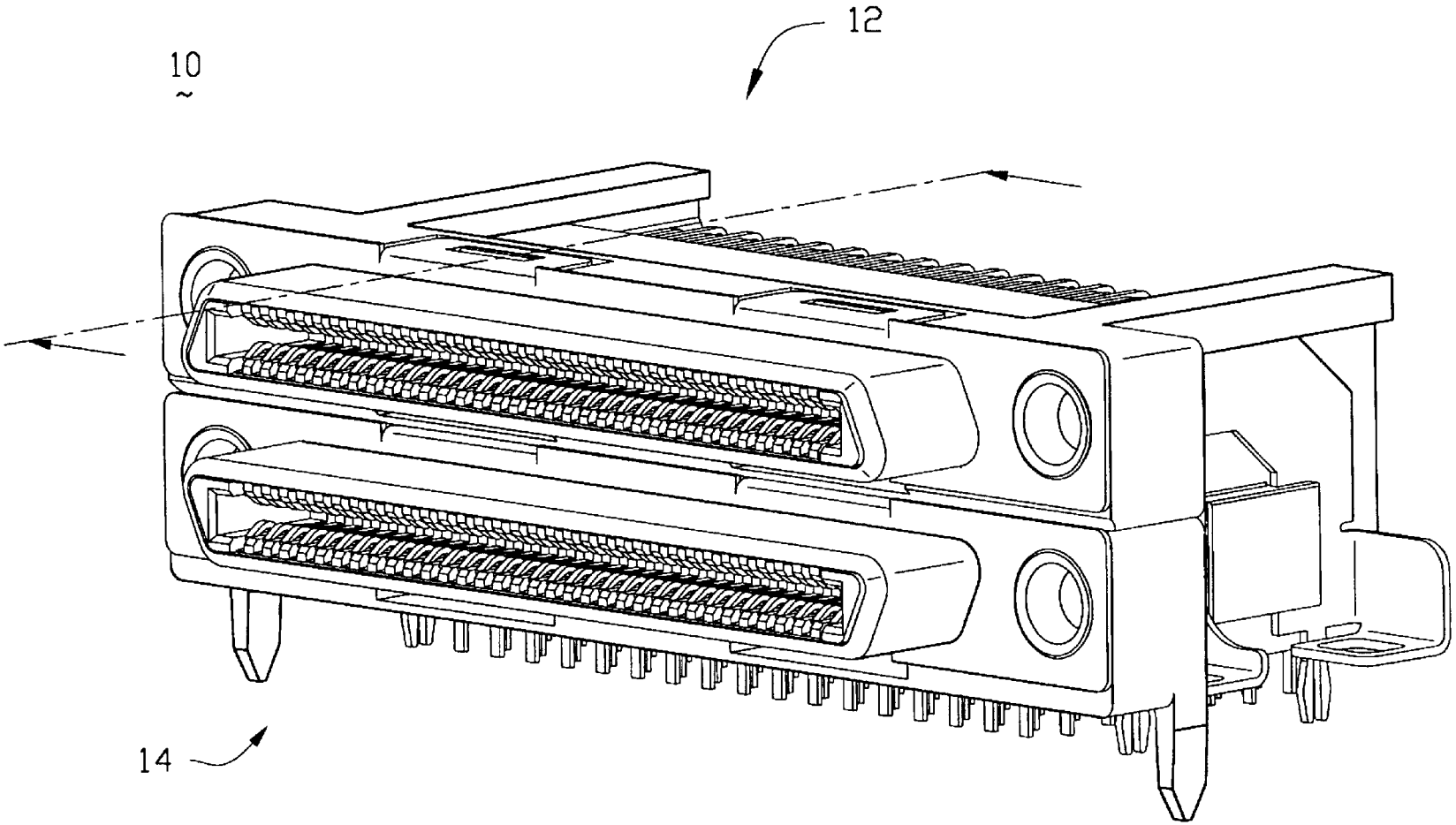
FIG. 1 is an perspective view of a stacked connector assembly according to a preferred embodiment of the present invention.
Figure 2:
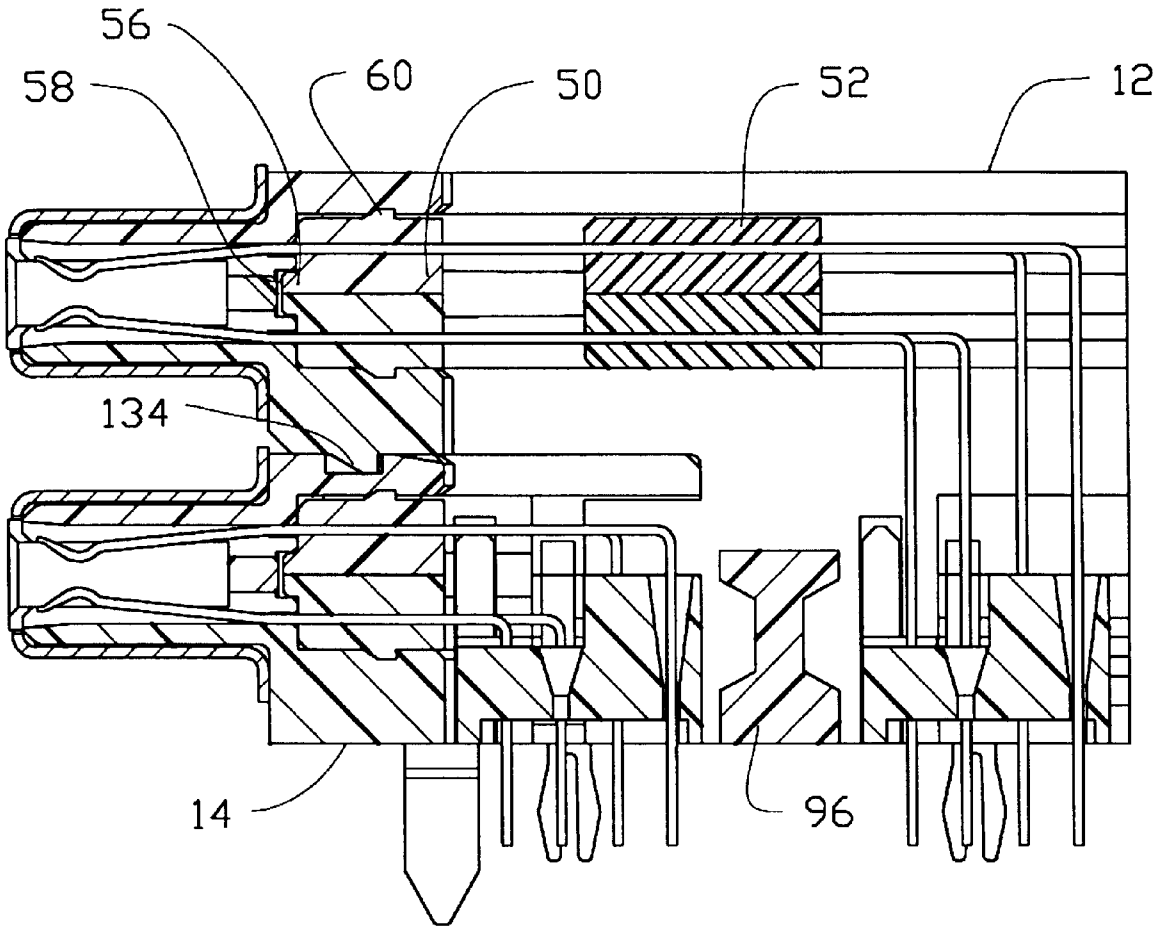
FIG. 2 is a cross-sectional view of the stacked connector assembly shown in FIG. 1.
Figure 3:
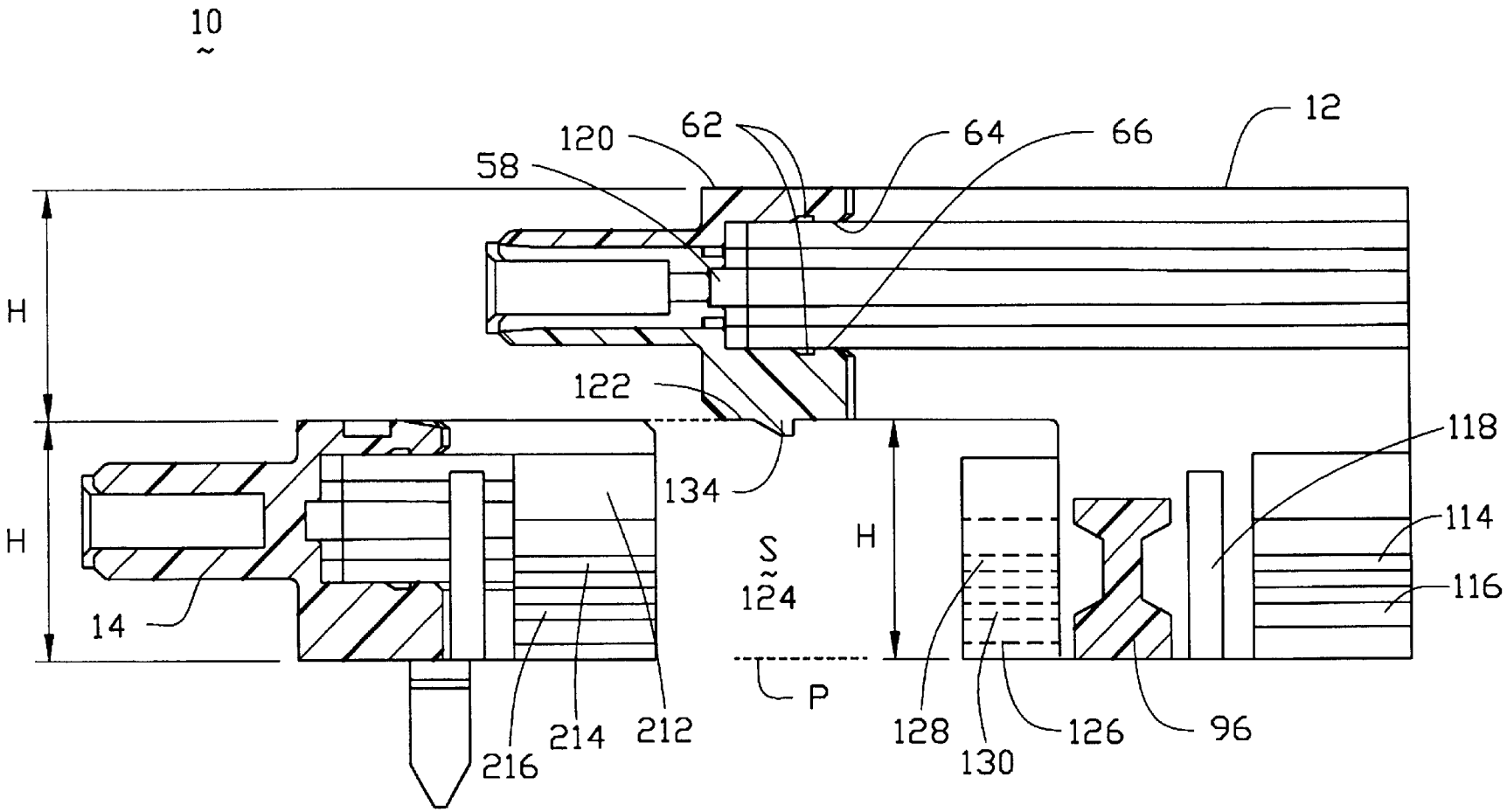
FIG. 3 shows a cross-sectional view of the upper connector and the lower connector of the stacked assembly of FIG. 1.

Referring first to FIGS. 1 to 3, a stacked connector assembly according to the present invention, generally designated by reference numeral 10, mainly comprises a first upper connector 12 and a second lower connector 14 secured to the upper connector 12.

Figure 4:
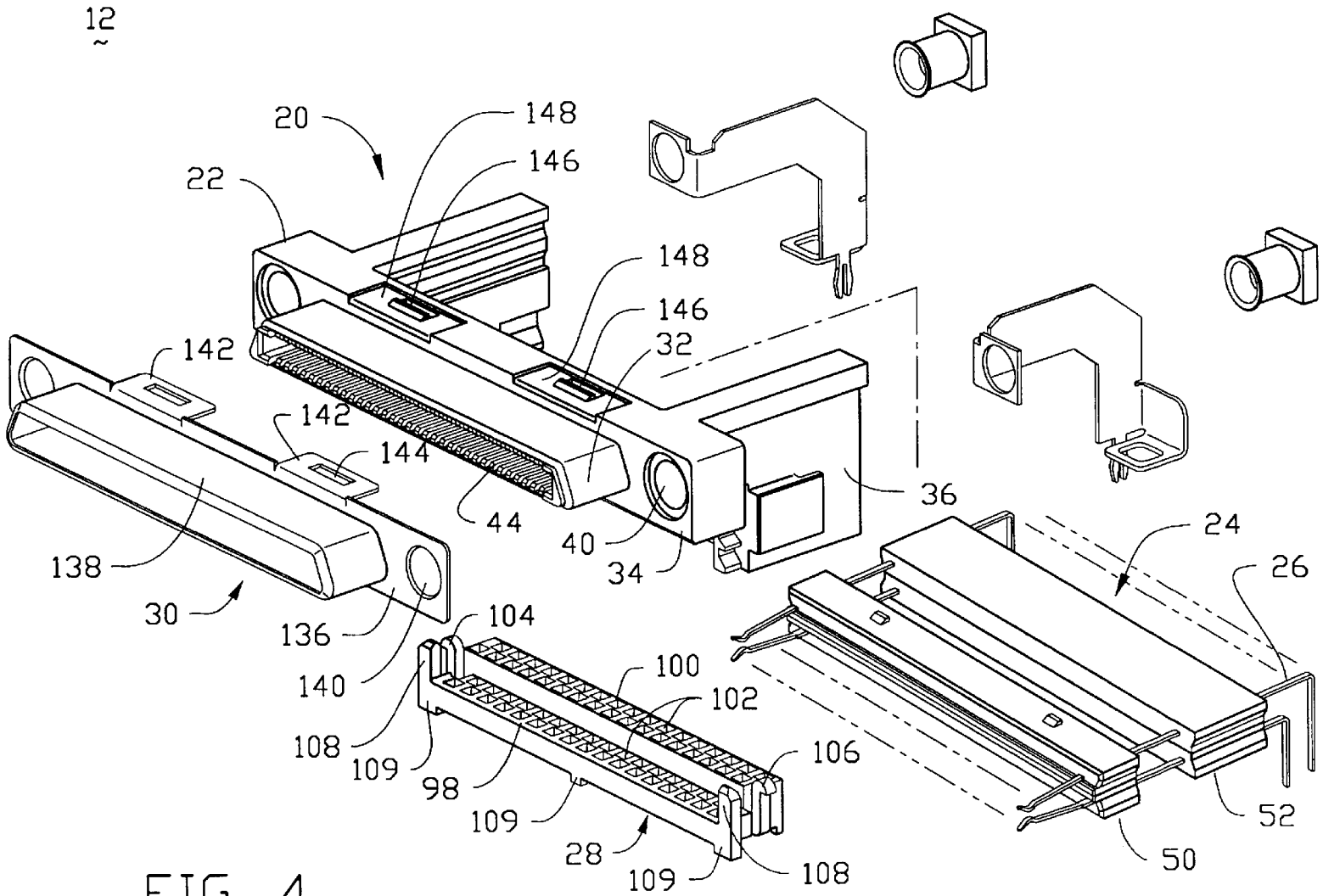
FIG. 4 is an exploded perspective view of the upper connector of the stacked assembly shown in FIG. 1.
Figure 5:
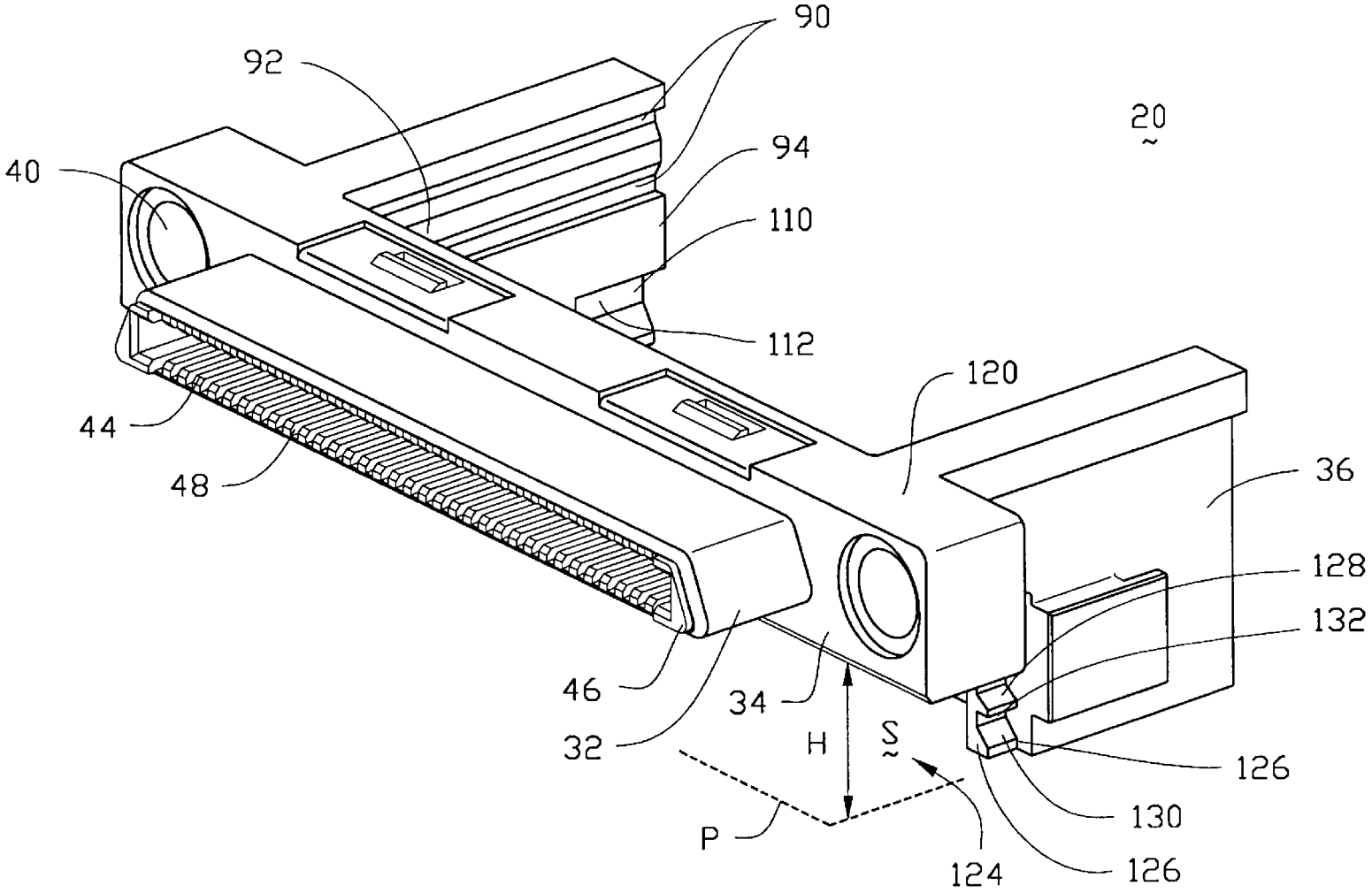
FIG. 5 is a front, upper perspective view of the upper connector.
Figure 6:
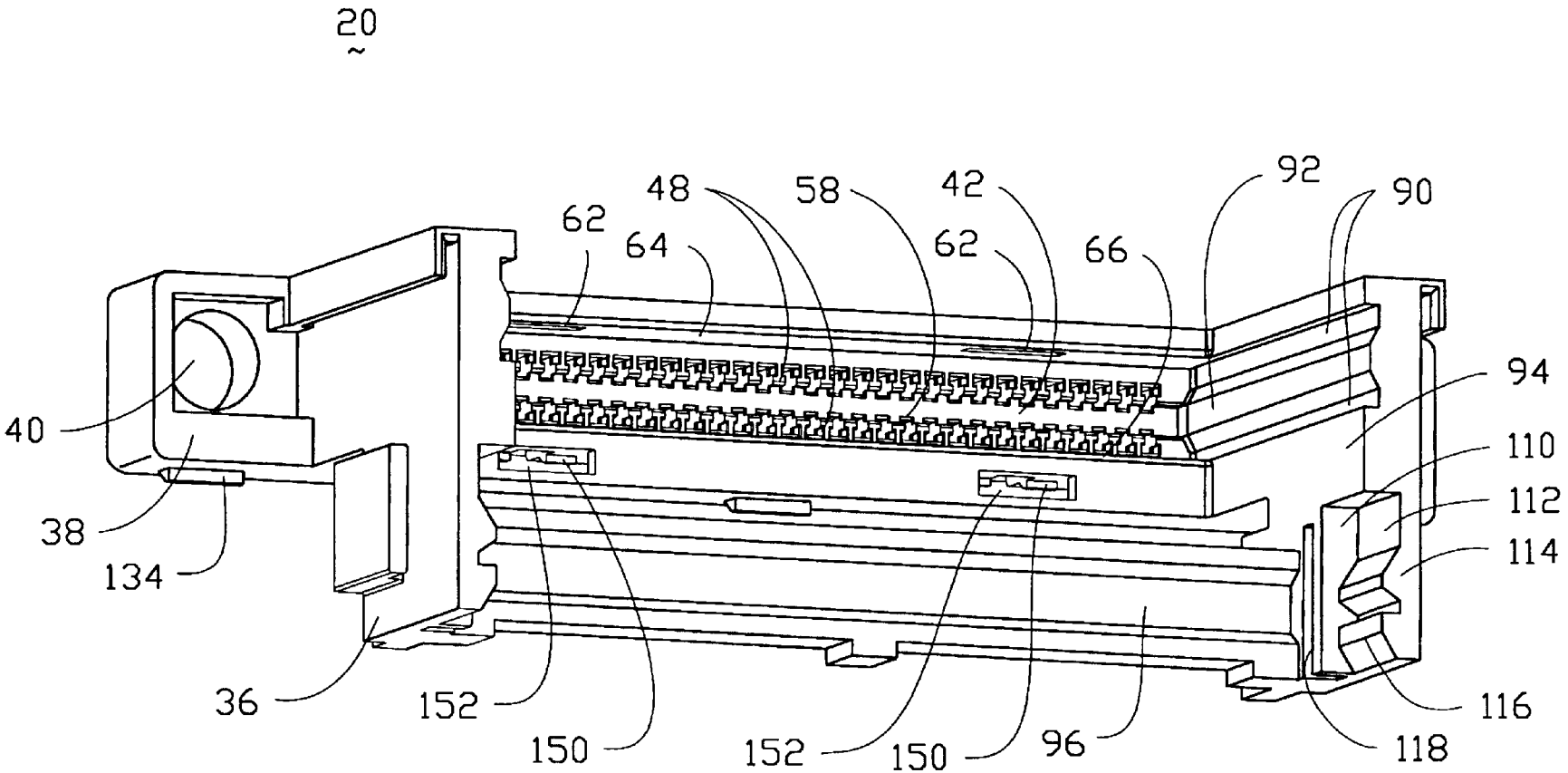
FIG. 6 is a rear, lower perspective view of the upper connector.

Please further refer to FIGS. 4 to 6. The upper connector 12 mainly comprises an insulative housing 20 having an elongated main body 22, a contact module 24 containing a plurality of conductive contacts 26, a spacer 28, and a metal shield 30.

The housing 20 includes a mating protrusion 32 projecting forward from a front face 34 of the main body 22 for mating with a mating connector (not shown), a pair of supports 36 extending rearward from a rear face 38 of the main body 22 for supporting the upper connector 12 in an elevated level and for the attachment of the spacer 28, and a pair of screw holes 40 defined near both lateral ends of the main body 22 through the front face 34 and the rear face 38.

An elongated central cavity 42 is defined in the main body 22 and open to an exterior for receiving the contact module 24 inserted from the rear face 38 of the main body 22. An elongated mating opening 44 is defined in a front face 46 of the mating protrusion 32 for receiving a mating portion of the mating connector (not shown). Two rows of passageways 48 are formed between the central cavity 42 and the mating opening 44 and extend in an upper and a lower inner surface of the mating opening 44 for positioning a front portion (not labeled) of the contacts 26 of the contact module 24.

Figure 10:
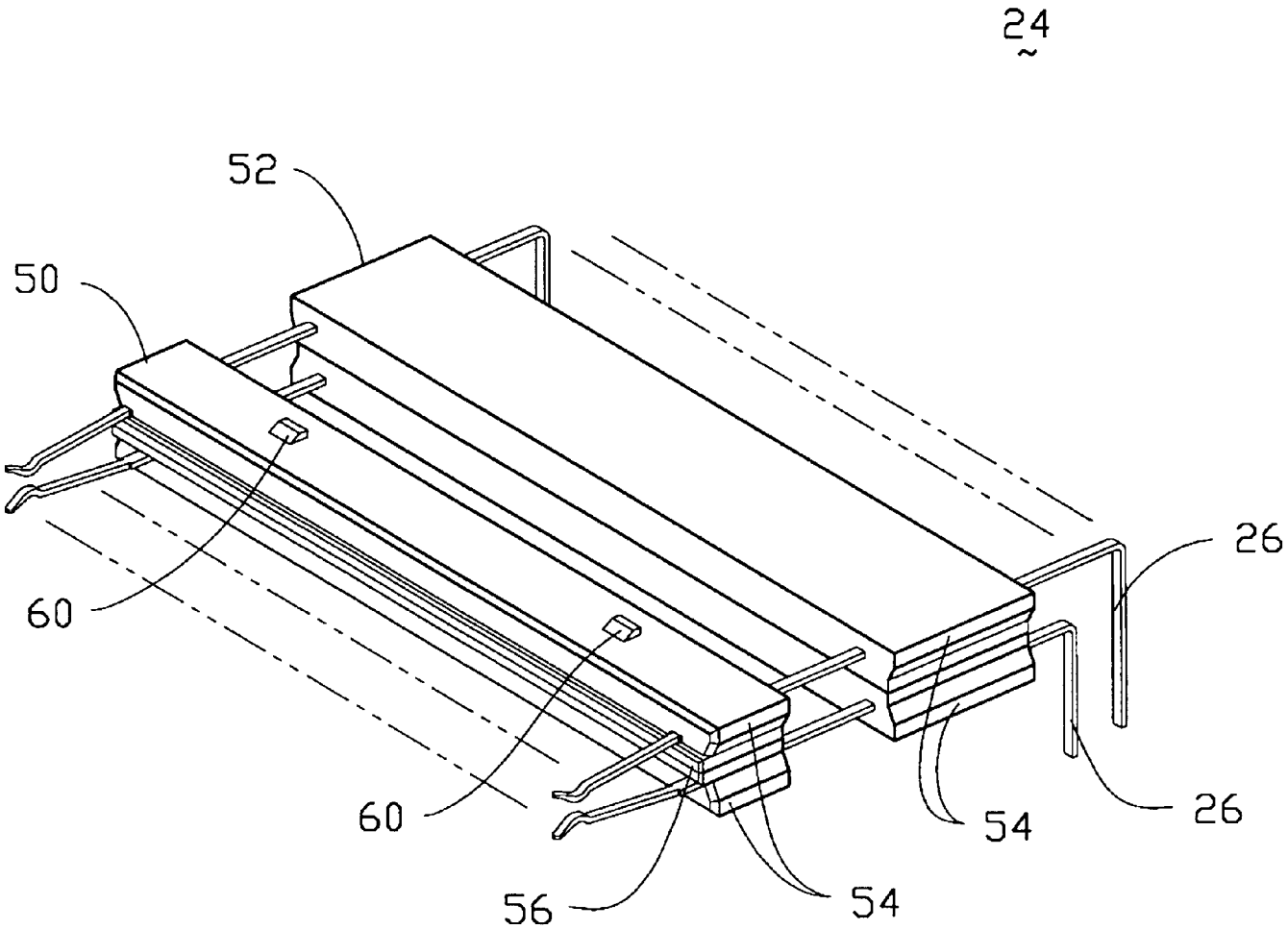
FIG. 10 is a front perspective view of the contact module of the upper connector.
Figure 11:
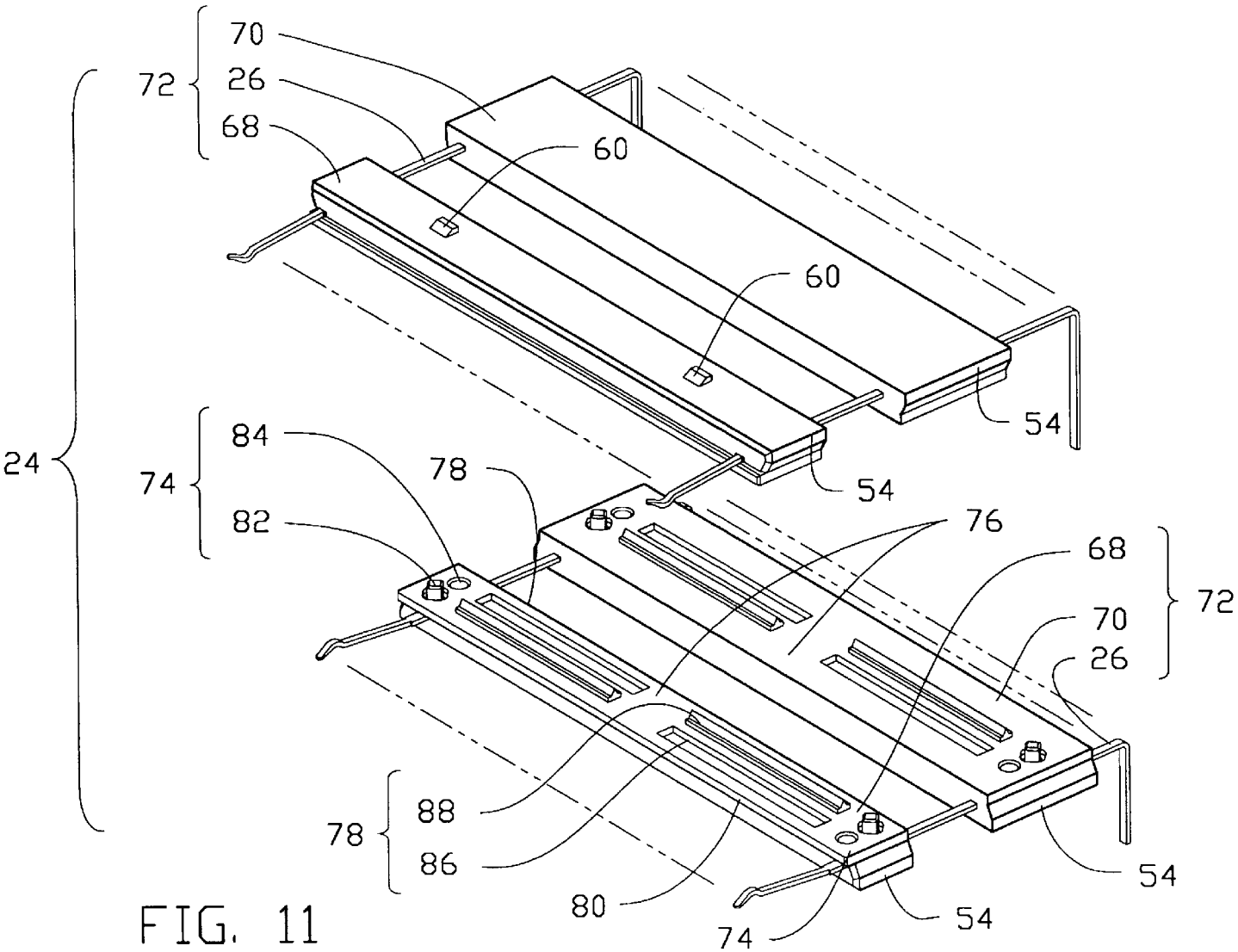
FIG. 11 is an exploded perspective view of the contact module of the upper connector.

Please refer to FIGS. 10 to 11. The contact module 24 includes two rows of contacts 26 integrally formed in a front block 50 and a rear block 52. Each of the front and rear blocks 50, 52 comprises a pair of upper and lower flanges 54, respectively, on each lateral side thereof for securing to the housing 20. The front block 50 further comprises a transverse protrusion 56 on a front side thereof for fitting into a transverse recess 58 defined on an innermost surface of the central cavity 42 of the housing 20, as shown in FIGS. 2, 3 and 6. Two pairs of ribs 60 are formed on an upper and a lower surface of the front block 50 for retention in two pairs of detents 62 defined on an inner upper and an inner lower surface 64, 66 of the central cavity 42 of the housing 20, as shown in FIG. 3.

In manufacturing, each row of contacts 26 are transversely aligned horizontally up side by side and inserted molded in a front plate 68 and a rear plate 70 to form a contact set 72 with the right-angled tail portions of the contacts 26 staggered in two rows. Next, two contact sets 72 are jointed together by means of joint means 74 formed on a jointing face 76 defined on each of the plates 68, 70. Since the tail portions of the contacts 26 in the two contact sets 72 are bent at different locations and in opposite direction relative to the their respective jointing face 76, there are four rows tail portions of the contacts 26 in the jointed contact sets 72. Finally, the jointed contact sets 72 are processed by ultrasonic welding procedure to bond the two pairs of plates 68, 70 into the front and rear blocks 50, 52, respectively, so that a unitary contact module 24 including the front and rear blocks 50, 52 with two rows of contacts 26 integrally formed therein is completed. Since the structures of the plates 68, 70 are similar, only the structure of the front plate 68 will be described in detail.

The front plate 68 comprises two sets of joint means 74 on an upper surface and near both lateral sides thereof, two sets of bonding means 78 between the joint means 74, a pair of flanges 54 formed on both lower lateral edges of the plate 68, a flange 80 formed on an upper front edge of the plate 68, and a pair of ribs 60 formed on a lower surface of the plate 68. Each set of the joint means 74 includes a square post 82 and a circular hole 84 and each set of bonding means 78 includes an elongated shallow 86 and a strip 88 wherein the posts 82 and holes 84 in the two sets of joint means 74 are located in exchanged positions and so do the elongated shallows 86 and strips 88 of the bonding means.

When the pair of plates 68 are jointed together, the two sets of joint means 74 of one front plate 68 interferingly engage with another two sets of joint means 74 of the other front plate 68 with the posts 82 of plates 68 fitting into the holes 84 of the mating plates 68, the elongated shallows 86 and strips 88 in one plate 68 engage the strips 88 and shallows 86 of the other plate 68, respectively, and the two front flanges 80 overlap and form the transverse protrusion 56 of the block 50. The strips 88 will melt during the ultrasonic welding procedure, and bond into the shallows 86 when they are cold.

In this embodiment, the rear plate 70 does not include the front flange 80, and thus the rear block 52 formed by two rear plates 70 does not include the transverse protrusion 56. It is noted that in another embodiment the rear plate 70 can also include the front flange 80 and thus the rear block 52 also includes the transverse protrusion 56 to simplify the molding of the blocks 50, 52.

Please refer back to FIGS. 5 and 6. The support 36 is substantially a rectangular wall integrally formed with the main body 22 of the housing 20 beside the central cavity 42. Two guiding grooves 90 defined on each lateral surface 92 of the central cavity 42 extend on an inner surface 94 of the support 36 for guiding the horizontal movement of the flanges 54 of the front and rear blocks 50, 52 during insertion of the contact module 24 into the central cavity 42 and for preventing vertical movement of the blocks 50, 52, and in turn, of the contact module 24 with respect to the housing 20 after insertion. A transverse beam 96 (see FIGS. 2 and 3) is provided between the supports 36 for reinforcing the strength of the housing 20 and for keeping a constant distance between the supports 36 so as to snugly receive the spacer 28 therebetween.

Figure 7:
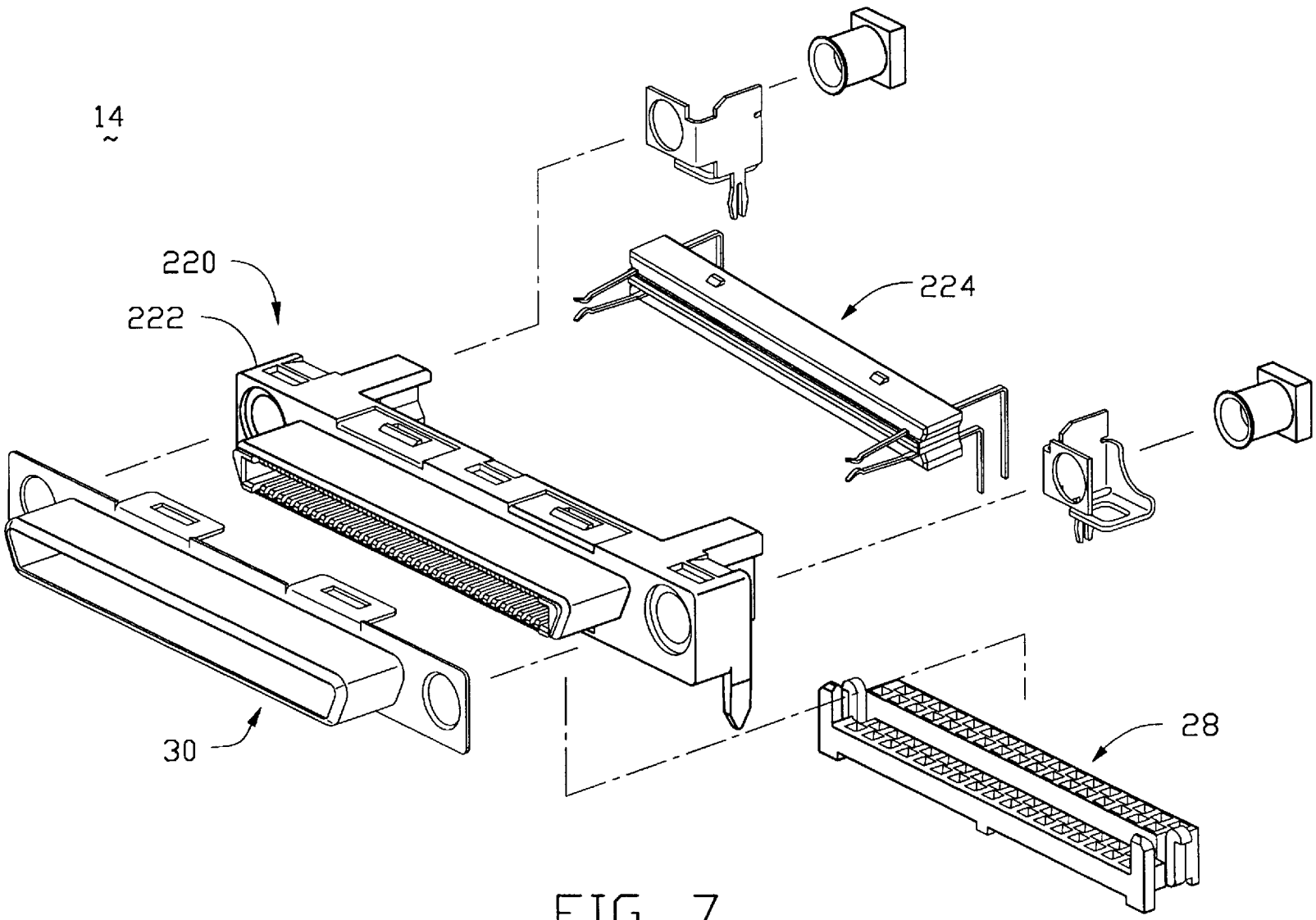
FIG. 7 is an exploded perspective view of the lower connector of the stacked assembly shown in FIG. 1.

Please refer to FIGS. 2, 4 and 7. The spacer 28 comprises a front thin bar 98 and a rear thick bar 100 integrally formed together. Each of the bars 98, 100 defines two rows of staggered tapered apertures 102 extending through a top and a bottom surface thereof for guiding and positioning the contacts 26. A pair of hooks 104, 106 are formed on opposite lateral sides of the spacer 28, one for each bar 98, 100, for locking the spacer 28 between the supports 36 and a pair of up-standing keys 108, which are taller than the pair of hooks 104, 106, are provided on both lateral ends of the front bar 98 for guiding attachment of the spacer 28 to the supports 36. In addition, six standoffs 109 are provided on a bottom surface of the spacer 28 located near edges thereof.

Please refer to FIGS. 3, 5 and 6. A recess 110 is formed on the inner surface 94 of the support 36, which recess 110 locates near a lower, rear portion of the support 36 and defines a lateral inner surface 112. An upper and a lower horizontal retention ridges 114, 116 are formed on the lateral inner surface 112 for retaining the hooks 104, 106 of the spacer 28. A vertical slit 118 is defined on the inner surface 94 of the support 36 ahead of the recess 110 for receiving the keys 108 of the spacer 28.

Please further refer to FIG. 3. A top surface of the support 36 is flush with a top surface 120 of the main body 22 and the height of the support 36 is substantially twice as much as that of the main body 22 such that a bottom surface of the support 36 is substantially lower than a bottom surface 122 of the main body 22 by the high "H" of the main body 22. Therefore, a space 124, "S", is defined between the bottom surface 122 of the main body 22 and a plane "P" coplanar with the bottom surface of the support 36 for receiving the lower connector 14.

The upper connector 12 further comprises a pair of positioning plates 126 extending forward from both of the supports 36, each defines an upper and a lower horizontal retention groove 128, 130 on a lateral outer surface 132 thereof for positioning the lower connector 14. In addition, three ribs 134 are formed on the lower surface of the main body 22 for locking into the lower connector 14.

Please refer to FIGS. 4 and 7. The metal shield 30 comprises a main plate 136, a hollow shell 138 drawn forward from a central portion thereof, a pair of screw holes 140 defined on both ends of the main plate 136, and two pairs of mounting ears 142 respectively extending rearward from a top edge and a bottom edge of thereof. When the metal shield 30 is mounted on the housing 20, the main plate 136 abuts the front face 34 of the main body 22 of the housing 20 with the hollow shell 138 conformably encompassing the mating protrusion 32 and the screw holes 140 aligning with the screw holes 40 of the housing 20 (see FIG. 1). Each of the mounting ears 142 of the metal shield 30 defines a central slot 144. Each of the central slots 144 defined on the upper mounting ears 142 retains a rib 146 formed on a recession 148 defined in top surface 120 of the main body 22 of the housing 20 and each of the central slots 144 defined on the lower mounting ears 142 retains at least one ribs 150 formed on an inner top surface of a recession 152 defined in the front face 34 of the main body 22 below the mating protrusion 32 (see FIG. 6).

Figure 8:
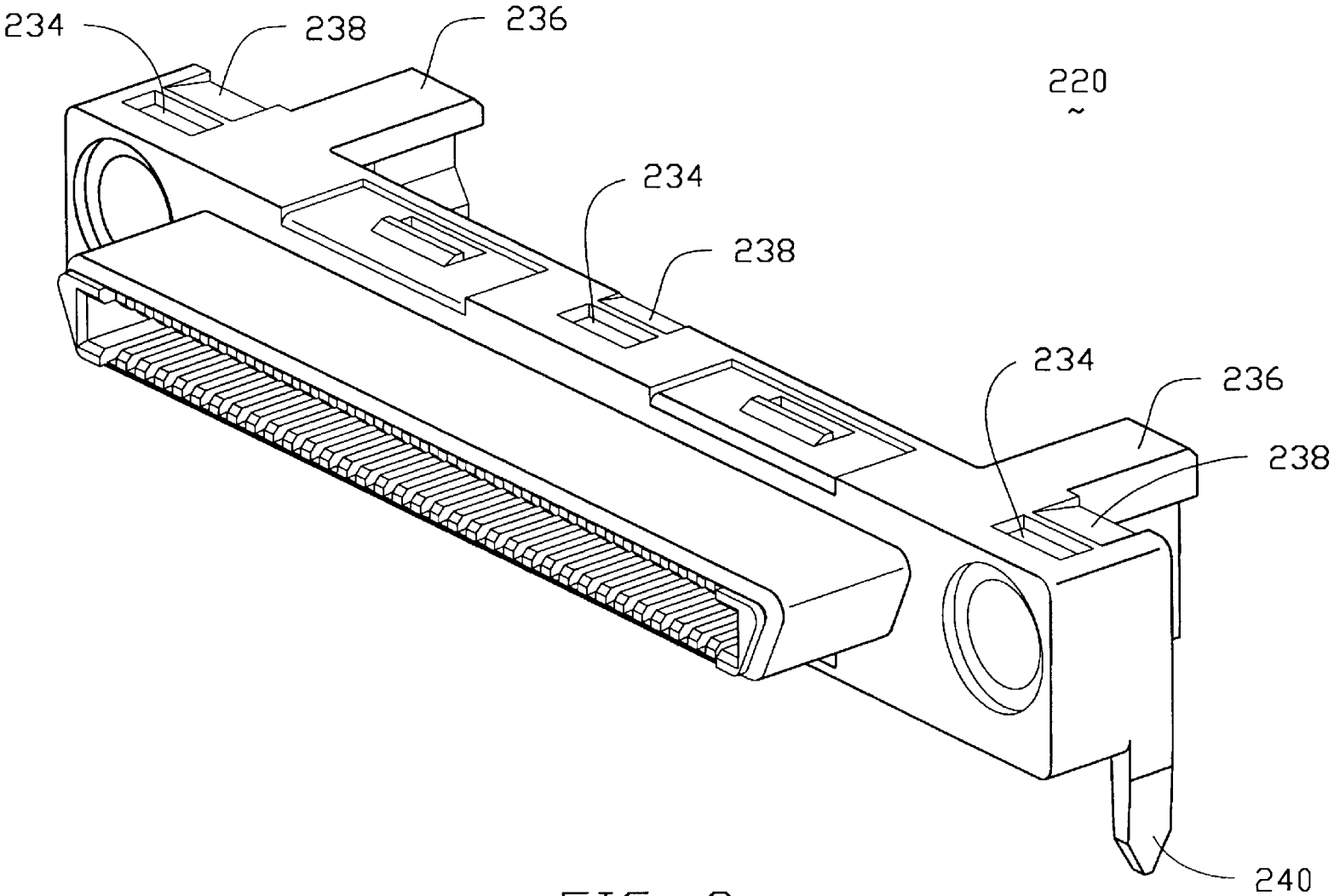
FIG. 8 is a front, upper perspective view of the lower connector.
Figure 9:
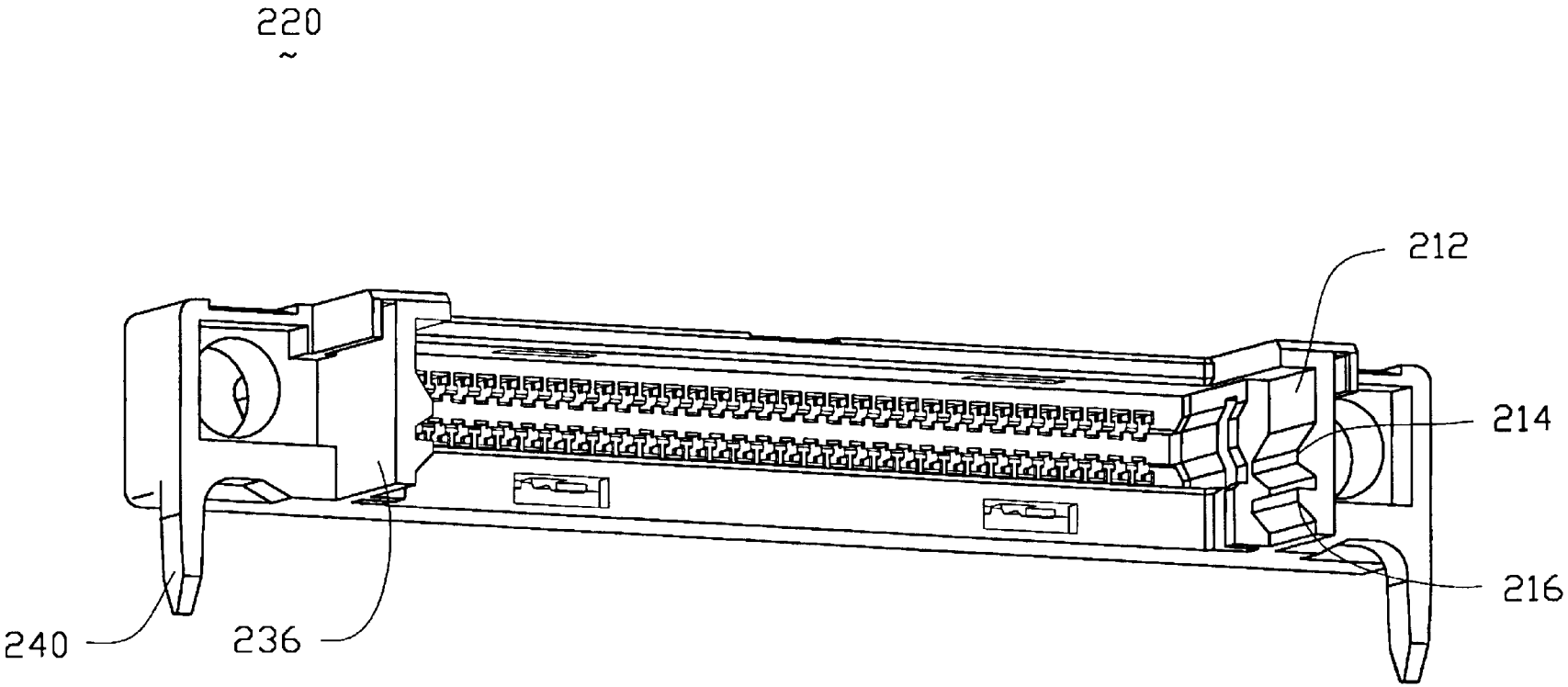
FIG. 9 is a rear, lower perspective view of the lower connector.

Please refer to FIGS. 7 to 9. The structure of the lower connector 14 is similar to that of the upper connector 12, and mainly comprises an insulative housing 220, a contact module 224, a spacer 28, and a metal shield 30.

The housing 220 is substantially similar to the housing 20 except for the following differences. The housing 220 comprises two positioning walls 236 extending rearward in place of the supports 36 of the housing 20. The positioning walls 236 extend rearward from a rear surface of a main body 222 of the housing 220, and each defines an upper and a lower horizontal retention ridge 214, 216 formed on a lateral inner surface 212 thereof, as are the ridges 114, 116 of the support 36 of the upper connector 12, for retaining the hooks 104, 106 of the spacer 28 and for complementarily positioning into the upper and lower horizontal retention grooves 128, 130 of the positioning latches 126 of the support 36 of the upper connector 12, as can be seen in FIGS. 3 and 5, thus restraining the relative movement between the upper connector 12 and the lower connector 14 in a vertical direction.

In addition, three detents 234 are formed on an upper surface of the main body 222 for retention of the three ribs 134 on the lower surface of the main body 22 of the upper connector 12, and a recessed slant surface 238 provided on a rear portion of each detents 234 for guiding the entrance of the rib 134 into the detent 234, thus preventing the relative movement between the upper connector 12 and the lower connector 14 in a horizontal direction.

Please refer to FIG. 3. Since the height of the main body 222 of the lower connector 14 is substantially the same as the height "H" of the upper connector 12, and the upper and lower surfaces of the positioning walls 236 are flush with those of main body 222, the lower connector 14 can then be snugly received within the space 124 ("S") of the upper connector 12.

The lower connector 14 further comprises a pair of posts 240 extending downward from both lateral ends of the main body 222 for locking into a PC board (not shown) on which the lower connector 14 is to be mounted.

Figure 12:
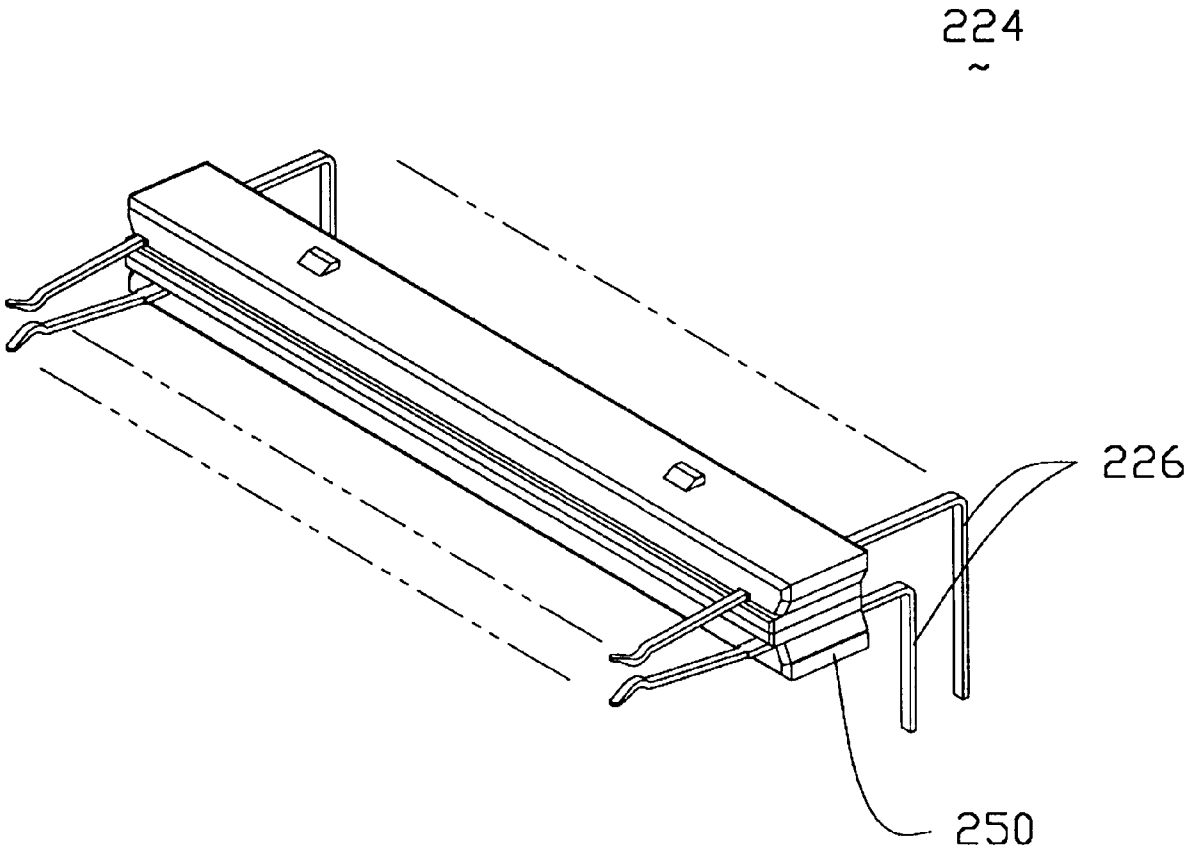
FIG. 12 is a front perspective view of the contact module of the lower connector.

Please further refer to FIG. 12. The contact module 224 is similar to the contact module 24 of the upper connector 12, includes two rows of contacts 226 integrally formed in a block 250. The structure and manufacture of the block 250 are substantially the same as the front block 50 of the upper connector 12, and thus will not be further described hereinafter.

As can be seen in FIGS. 2 and 3, in assembling, the lower connector 14 is inserted into the space "S" 124 of the upper connector 12 from a lower front position thereof. With the cooperation of the positioning walls 236 and detents 234 of the lower connector 14 with the positioning plates 126 and ribs 134 of the upper connector 12, respectively, the two connectors 12, 14 can be effectively stacked together.

Although in the preferred embodiment the lower connector 14 is designed to be stacked with the upper connector 12, it can also be use singly as a non-stacked connector.

In the present embodiment, the larger supports 36 are provided on the upper connector 12 and the smaller positioning walls 236 are provided on the lower connector 14; however, the larger supports 36 can be provided on the lower connector 14 rather than on the upper connector 12 and the smaller positioning walls 236 can be provided on the upper connector 12 rather than the lower connector 14 to retainably engage with each other.

Although in the preferred embodiment, the upper and lower connectors 12, 14 are of the same type, it should be noted that, alternatively, the lower connector 14 can be of different type from the upper connector 12 and has a structure different from that of the upper connector 12 while defining a dimension capable of being snugly received in the space 124 of the upper connector 12 and including means retainably engaging with the upper connector 12.

In a variation of the present invention, more than one lower connectors 14', 14" . . . can be snugly received in the space 124 of the upper connector 12, each of which lower connectors 14', 14" includes means retainably engaging with the upper connector 12.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. A stacked connector assembly, comprising:

a first electrical connector including a first insulative housing defining a front face for mating with a first mating connector, a plurality of conductive contacts received in a plurality of passageways defined in a first main body of the first housing, a pair of supports integrally extending rearwardly from a rear face of the first main body of the first housing, a metal shield provided on a front portion of the first housing for eliminating electromagnetic interference, and a space defined under a bottom surface of the first main body of the first housing in front of the supports;

a second electrical connector adapted to be snugly received in said space of the first connector in front of the supports, including a second insulative housing defining a front face for mating with a second mating connector, a plurality of conductive contacts received in a plurality of passageways defined in a second main body of the second housing, and a metal shield provided on a front portion of the second housing for eliminating electromagnetic interference; and means having parts integrally formed with said first and second connector, respectively, for retaining said first and second connectors to each other; wherein said first main body of the first connector and said second main body of the second connector are vertically aligned with each other.

2. The stacked connector assembly as claimed in claim 1, further comprising a transverse beam provided between the supports.

3. A stacked connector assembly, comprising:

an upper electrical connector including a first insulative housing defining a front face for mating with a first mating connector, a plurality of conductive contacts received in a plurality of passageways defined in the first housing, a pair of supports downward extending from a rear face of the first housing, a pair of positioning plates integrally extending forwardly of both supports, a spaces defined under a bottom surface of the first housing but in front of the positioning plates of the supports, and a first spacer provided between the supports;

a lower electrical connector snugly entirely received within said space of the upper connector, including a second insulative housing defining a front face for mating with a second mating connector, a plurality of conductive contacts received in a plurality of passageways defined in the second housing, a pair of positioning walls extending rearward of a face of the second housing thereby retainably engaging said positioning plates of the first connector within the space, and a second spacer provided between the positioning walls.

4. A stacked connector assembly comprising:

an upper connector and a lower connector;

said upper connector including a first insulative housing defining a first mating face for engaging a first mating connector, a pair of supports integrally extending rearwardly from a rear face of a first main body of the first housing;

said lower connector including a second insulative housing defining a second main body with a second mating face for engaging a second mating connector, said first main body of the upper connector being vertically aligned with the second main body of the lower connector; and means for combining the upper connector and the lower connector together; wherein said means includes a pair of positioning plates integrally extending forwardly from and parallel to said pair of supports of the upper connector, respectively, and a pair of lateral inner surfaces formed on the lower connector for respectively latchable engagement with said pair of positioning plates.

5. The connector assembly as claimed in claim 4, wherein said means further includes a rib formed on one of a bottom face of the first main body and a top face of the second main body, and a complementary detent in the other of said bottom face of the first main body and said top face of the second main body for restraining relative movement between said first connector and said second connector in a horizontal direction.

6. A stacked connector assembly including an upper and a lower electrical connector of the same type, including:

said upper connector including a first insulative housing defining a front face for mating with a first mating connector, a plurality of first conductive contacts received in a plurality of passageways defined in the first housing, a pair of supports downward extending from a rear face of the first housing, a space defined under a bottom surface of the first housing but in front of the supports, a first retention portion forwardly extending from each support toward the space, and a first spacer attached into the supports and downward guiding a tail portion of each first contacts out of a bottom of stacked connector assembly; and said lower connector including a second insulative housing defining a front face for mating with a second mating connector, a plurality of second conductive contacts received in a plurality of passageways defined in the second housing, a pair of positioning walls horizontally extending rearward from the housing, a second spacer attached into the walls and downward guiding a tail portion of each second contact out of the bottom of the stacked connector assembly, and a second retention portion extending from an inner surface of each of said positioning walls in retentive and complementary engagement with the corresponding first retention portion in position within the space.

7. A stacked connector assembly including an upper and a lower electrical connector of the same type, including:

said upper connector including a first insulative housing defining a front face for mating with a first mating connector, a plurality of first conductive contacts received in a plurality of passageways defined in the first housing, a pair of supports downward extending from a rear face of the first housing, a space with a height defined under a bottom surface of the first housing but in front of the supports, a first retention portion extending from the first housing toward the space, and a first spacer attached between the supports and downward guiding a tail portion of each first contacts out of a bottom of stacked connector assembly; and said lower connector including a second insulative housing defining a front face for mating with a second mating connector, a plurality of second conductive contacts received in a plurality of passageways defined in the second housing, a pair of positioning walls horizontally extending rearward from the housing, a second spacer attached between the walls and downward guiding a tail portion of each second contact out of the bottom of the stacked connector assembly, a second retention portion extending from the second housing in shape complementary to the corresponding first retention portion for restraining the lower connector from motion along a specific direction with regard to the upper connector wherein the lower connector is snugly received within the space of the upper connector from a lower front position by means that a height of the second housing of the lower connector is the same as that of the space of the upper connector, and the lower connector abuts against the bottom surface of the first housing of the upper connector.

* * * * *